US012031292B2

(12) United States Patent
Anderson et al.

(10) Patent No.: US 12,031,292 B2
(45) Date of Patent: Jul. 9, 2024

(54) SYSTEMS AND METHODS FOR REDUCING OR PREVENTING PLUGGAGE IN AN EXCAVATION VACUUM APPARATUS

(71) Applicant: Vermeer Manufacturing Company, Pella, IA (US)

(72) Inventors: Thor Anderson, Monroe, IA (US); Jacob Keeley, Ankeny, IA (US); Conner Converse, Oskaloosa, IA (US); Andrew Strobel, Knoxville, IA (US); Brandon Lane Storm, Reasnor, IA (US)

(73) Assignee: Vermeer Manufacturing Company, Pella, IA (US)

( * ) Notice: Subject to any disclaimer, the term of this patent is extended or adjusted under 35 U.S.C. 154(b) by 797 days.

(21) Appl. No.: 17/031,186

(22) Filed: Sep. 24, 2020

(65) Prior Publication Data

US 2021/0087784 A1 Mar. 25, 2021

Related U.S. Application Data

(60) Provisional application No. 62/905,043, filed on Sep. 24, 2019.

(51) Int. Cl.

| | |
|---|---|
| ***E02F 3/94*** | (2006.01) |
| ***E02F 3/88*** | (2006.01) |
| ***E02F 9/20*** | (2006.01) |
| ***E02F 9/26*** | (2006.01) |

(52) U.S. Cl.

CPC ..... *E02F 3/94* (2013.01); *E02F 3/8816* (2013.01); *E02F 9/2025* (2013.01); *E02F 9/26* (2013.01)

(58) Field of Classification Search

CPC ..... E02F 3/94; E02F 3/8816; E02F 9/2025; E02F 9/26

See application file for complete search history.

(56) References Cited

U.S. PATENT DOCUMENTS

| | | | |
|---|---|---|---|
| 2,156,333 | A | 5/1939 | Cross et al. |
| 2,225,973 | A | 12/1940 | Brown et al. |
| 2,576,283 | A | 11/1951 | Chaney |
| 2,919,898 | A | 1/1960 | Marwil et al. |
| 3,289,775 | A | 12/1966 | Stone |
| 3,766,997 | A | 10/1973 | Heilhecker et al. |

(Continued)

FOREIGN PATENT DOCUMENTS

| | | |
|---|---|---|
| EP | 3141693 B1 | 3/2017 |
| WO | 2008082424 | 7/2008 |

(Continued)

OTHER PUBLICATIONS https://vac-con.com/hydro-excavators, available before Sep. 24, 2019.

*Primary Examiner* — Jamie L McGowan

(74) *Attorney, Agent, or Firm* — Armstrong Teasdale LLP

(57) ABSTRACT

Systems for reducing or preventing pluggage of spoil material in an excavation vacuum apparatus wherein the pluggage prevention system of the excavation vacuum apparatus may trigger one or more mitigation operations (e.g., addition of water through spray nozzles) to loosen the build-up of spoil material and/or to at least partially shut down the excavation vacuum apparatus to prevent more material being fed to the system.

37 Claims, 13 Drawing Sheets

(56) References Cited

U.S. PATENT DOCUMENTS

| | | | | |
|---|---|---|---|---|
| 3,930,324 | A * | 1/1976 | Wightman | E02F 3/8825 37/189 |
| 3,989,311 | A | 11/1976 | De brey | |
| 4,634,535 | A | 1/1987 | Lott | |
| 4,882,054 | A | 11/1989 | Derrick et al. | |
| 5,295,317 | A | 3/1994 | Perrott | |
| 6,213,227 | B1 | 4/2001 | Dietzen | |
| 6,453,584 | B1 | 9/2002 | Buckner | |
| 6,470,605 | B1 | 10/2002 | Gilman et al. | |
| 6,517,733 | B1 | 2/2003 | Carlson | |
| 6,578,293 | B1 * | 6/2003 | Ainsworth | E02F 3/902 37/317 |
| 6,942,717 | B2 | 9/2005 | Armstrong et al. | |
| 6,988,568 | B2 | 1/2006 | Buckner | |
| 7,306,057 | B2 | 12/2007 | Strong et al. | |
| 7,337,860 | B2 | 3/2008 | McIntyre | |
| 7,523,570 | B2 | 4/2009 | Pobihushchy | |
| 7,644,523 | B2 | 1/2010 | Buckner | |
| 7,690,445 | B2 | 4/2010 | Perez-Cordova | |
| 8,172,740 | B2 | 5/2012 | El Dorry et al. | |
| 8,561,803 | B2 | 10/2013 | Fallon | |
| 8,613,360 | B2 | 12/2013 | Carr | |
| 9,045,072 | B2 | 6/2015 | Hetcher et al. | |
| 9,073,104 | B2 | 7/2015 | Burnett et al. | |
| 9,079,188 | B2 | 7/2015 | Culver | |
| 9,662,599 | B2 | 5/2017 | Sewell et al. | |
| 10,399,017 | B2 | 9/2019 | Sewell et al. | |
| 11,111,743 | B2 | 9/2021 | Ross et al. | |
| 2002/0189139 | A1 * | 12/2002 | Buckner | E21B 21/066 37/317 |
| 2003/0136747 | A1 | 7/2003 | Wood et al. | |
| 2005/0242003 | A1 | 11/2005 | Scott et al. | |
| 2007/0163927 | A1 | 7/2007 | Eia | |
| 2007/0278012 | A1 | 12/2007 | Smith | |
| 2009/0120846 | A1 | 5/2009 | Burnett | |
| 2010/0196129 | A1 | 8/2010 | Buckner | |
| 2011/0214758 | A1 * | 9/2011 | Spitzer | E03F 1/006 137/511 |
| 2013/0248465 | A1 | 9/2013 | Sherwood | |
| 2015/0176243 | A1 | 6/2015 | Buckner | |
| 2019/0017243 | A1 | 1/2019 | Strobel et al. | |

FOREIGN PATENT DOCUMENTS

| | | | | |
|---|---|---|---|---|
| WO | 2019014515 | A1 | 1/2019 | |
| WO | WO-2019014515 | A1 * | 1/2019 | B01D 33/0353 |

* cited by examiner

SYSTEMS AND METHODS FOR REDUCING OR PREVENTING PLUGGAGE IN AN EXCAVATION VACUUM APPARATUS

CROSS-REFERENCE TO RELATED APPLICATION

This application claims the benefit of U.S. Provisional Patent Application No. 62/905,043, filed Sep. 24, 2019, which is incorporated herein by reference it its entirety.

FIELD OF THE DISCLOSURE

The present disclosure relates to systems and methods for monitoring an excavation vacuum apparatus and, in particular, systems and methods that sense build-up of spoil material to prevent pluggage of the system.

BACKGROUND

At least some known excavation vacuum systems involve directing high pressure water at an excavation site while removing cut earthen material and water by a vacuum system to perform an excavation operation. The spoil material is removed by entraining the spoil material in an airstream generated by the vacuum system. In some known excavation systems, the spoils are subsequently separated from the airstream by a spoil separation system. Spoil separation systems may utilize a plurality of processing units in order to remove water from the spent soils. After processing, the separated spoils are discharged from the separation system for reuse at the excavation site or for other disposal.

In some known cases, during the course of an excavation operation, spoils may begin to build-up in one or more of the components of the separation system. Build-up of spoils may decrease efficiency and adversely affect one or more processing units of the separation system. Further, spoil build-up in one unit affects adjacent processing units in a cascading effect. Specifically, if the spoil buildup is not detected and cleared in a timely manner, the spoil build-up may rapidly increase. The build-up may completely block the separation system causing damage to one or more components thereof. Additionally, clearing a blocked separation system and/or repairing processing units of the separation system may be a time consuming process that may delay project deadlines and increase the down time of the excavation apparatus. Further, clearing a plugged separation system may require that the excavation apparatus be transported to another location in order to avoid issues at the excavation site.

To prevent spoils pluggage in a separation system, an operator may need to diligently monitor the components of the separation system in order to ensure that the separation system is functioning properly and that spoils are not building up in the various processing units of the system. Monitoring spoil buildup may strain the operator because the operator's attention is drawn to multiple aspects of the excavation apparatus and the separation system during an excavation operation.

A need exists for methods and systems for identifying a spoils build-up condition on an excavation vacuum apparatus and for executing one or more clearing operations that may be used to mitigate further progression of the build-up. Additionally, in the event that the separation system becomes plugged, a need exists for automated shut-down operations to prevent further damage to the components of the separation system.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to a mobile excavation vacuum apparatus. The apparatus includes a vacuum system for removing spoil material from an excavation site by entraining the spoil material in an airstream. The system includes a disentrainment system for removing spoil material from the airstream. A pluggage monitoring system includes one or more sensors for measuring the weight of at least a portion of the disentrainment system. A chassis supports the mobile excavation apparatus and one or more wheels mounted to the chassis.

Another aspect of the present disclosure is directed to a disentrainment system for removing spoil material from an airstream. The disentrainment system includes one or more vessels and/or cyclones for continuously removing spoil material from the airstream. The disentrainment system includes a sensor system for weighing at least a portion of the disentrainment system. The disentrainment system includes a controller for receiving a signal from the sensor system to determine a measured weight of at least a portion of the disentrainment system. The controller is configured to compare the measured weight to a threshold weight. The controller is further configured to activate a spoil material clearing operation if the measured weight exceeds the threshold weight.

Yet another aspect of the present disclosure is directed to a method for monitoring build-up of spoil material in a disentrainment system of a mobile excavation vacuum apparatus. Spoil material is vacuumed from an excavation site by entraining the spoil material in an airstream. The airstream having spoil material entrained therein is introduced into a disentrainment system to remove the spoil material from the airstream. The weight of at least a portion of the disentrainment system is monitored to determine if spoil material is building up in the disentrainment system.

A further aspect of the present disclosure is directed to a mobile excavation vacuum apparatus. The apparatus includes a vacuum system for removing spoil material from an excavation site by entraining the spoil material in an airstream. The apparatus includes a disentrainment system for removing spoil material from the airstream. The disentrainment system includes an outlet through which spoil material is discharged from the disentrainment system. The disentrainment system has a vacuum tube in fluid communication with a vacuum pump. The vacuum tube has a flexible segment. The apparatus includes a mounting frame from which at least a portion of the disentrainment system is suspended. The mounting frame has first and second rotational joints. The flexible segment of the vacuum tube has an axis that passes through the second joint.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Provisions of the present disclosure relate to systems for reducing or preventing pluggage of spoil material in an excavation vacuum apparatus. The pluggage prevention system of the excavation vacuum apparatus may trigger one or more mitigation operations (e.g., addition of water through spray nozzles) to loosen the build-up of spoil material and/or to at least partially shut down the excavation vacuum apparatus to prevent more material being fed to the system.

Figure 1:
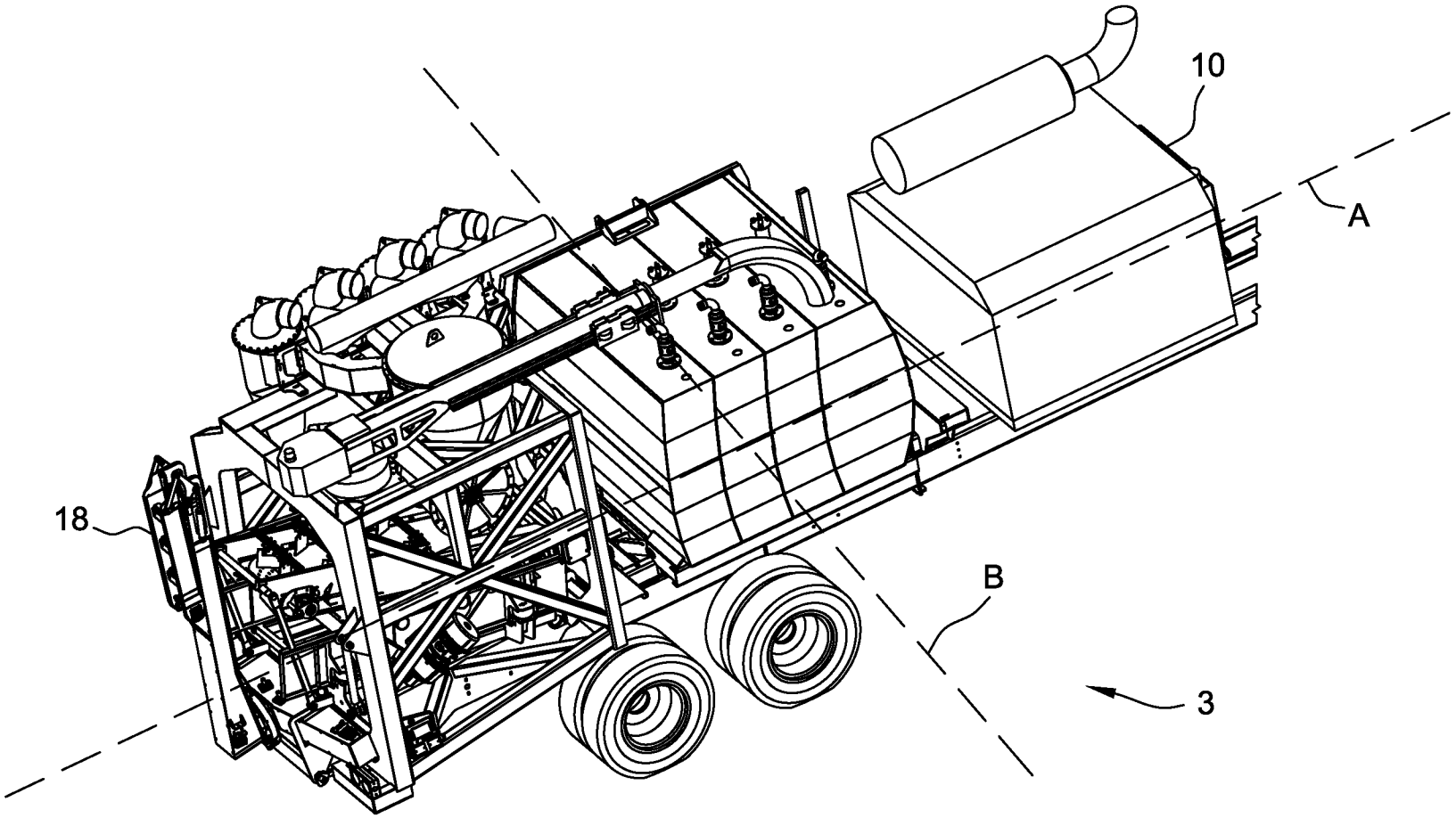
FIG. 1 is a perspective view of an excavation vacuum apparatus.
Figure 2:
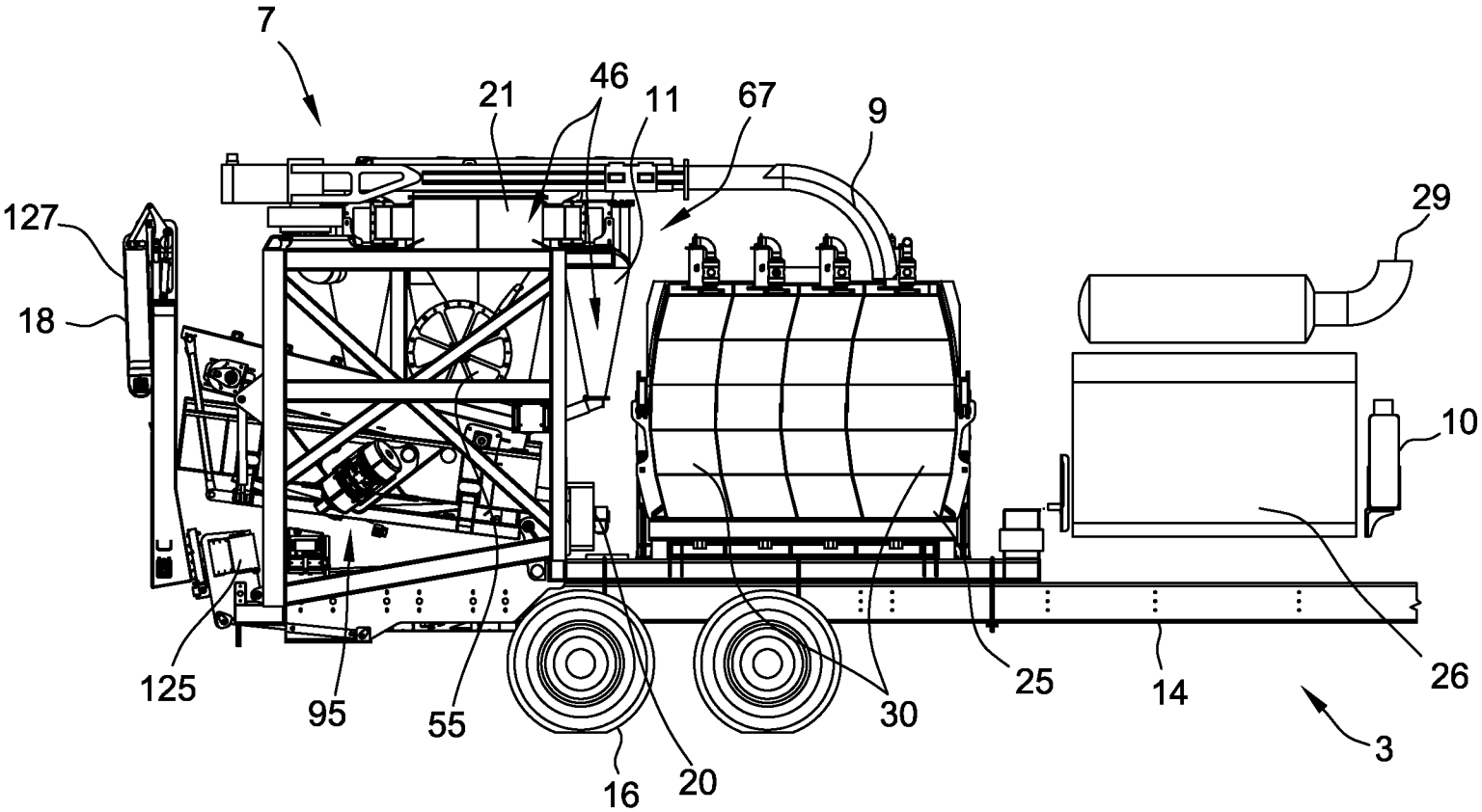
FIG. 2 is a side view of the excavation vacuum apparatus.

An example excavation vacuum apparatus 3 (or more simply "excavation apparatus 3" or even "apparatus 3") for excavating earthen material which may include a system for reducing or preventing build-up or pluggage of spoil material in accordance with embodiments of the present disclosure is shown in FIGS. 1 and 2. As described in further detail herein, the excavation apparatus 3 is used to excavate a site by use of a jet of high pressure water expelled through a wand. The cut earthen material and water are removed by a vacuum system and are processed onboard the apparatus by separating the cut earthen material from the water. Processed water may suitably be stored onboard (e.g., in one or more water tanks 30 (FIG. 4)) and used for additional excavation or disposed. Recovered earthen material is discharged from the apparatus 3 and may be used to backfill the excavation site or disposed.

It should be understood that while the excavation apparatus 3 may be described and shown herein as using high pressurized water for excavation, in other embodiments, the excavation apparatus may use high pressure air to excavate the site. Further, while the illustrated apparatus may process disentrained (i.e., separated) spoiled material such as by dewatering the spoiled material, in other embodiments the spoil material is not processed and is off-loaded without processing or is collected onboard.

The excavation apparatus 3 includes a front 10, rear 18, and a longitudinal axis A (FIG. 1) that extends through the front 10 and rear 18 of the apparatus 3. The apparatus 3 includes a lateral axis B that is perpendicular to the longitudinal axis A. An example excavation system is disclosed in U.S. Patent Publication No. 2019/0017243, entitled "Hydro Excavation Vacuum Apparatus and Fluid Storage and Supply Systems Thereof", which is incorporated herein by reference for all relevant and consistent purposes.

The excavation apparatus 3 may include a chassis 14 (FIG. 2) which supports the various components (e.g., vacuum system, disentrainment system and/or dewatering system) with wheels 16 connected to the chassis 14 to transport the excavation apparatus 3. The excavation apparatus 3 may be self-propelled (e.g., with a dedicated motor that propels the apparatus) or may be adapted to be towed by a separate vehicle (e.g., may include a tongue and/or hitch coupler to connect to the separate vehicle).

The excavation apparatus 3 includes a dedicated engine 26 that powers the various components such as the excavation pump, vacuum pump, vibratory screens, conveyors and the like. In other embodiments, the engine 26 is eliminated and the apparatus is powered by a motor that propels the apparatus or the excavation apparatus is powered by other methods.

The excavation apparatus 3 includes a wand 4 (FIG. 3) for directing pressurized water W toward earthen material to cut the earthen material (or for supplying a high pressure airstream as with air excavators). The wand 4 is connected to an excavation fluid pump 6 that supplies water to the wand 4.

The excavation apparatus 3 includes a vacuum system 7 (FIG. 2) for removing spoil material from the excavation site. Spoil material or simply "spoils" may include, without limitation, rocks, cut earthen material (e.g., small particulate such as sand to larger pieces of earth that are cut loose by the jet of high pressure water), slurry, vegetation (e.g., sticks, roots or grass) and water used for excavation. The spoil material may have a consistency similar to water, a slurry, or even solid earth or rocks. The terms used herein for materials that may be processed by the excavation apparatus 3 such as, for example, "spoils," "spoil material," "cut earthen material" and "water", should not be considered in a limiting sense unless stated otherwise.

The vacuum system 7 includes a boom 9 that is capable of rotating toward the excavation site to remove material from the excavation site. The boom 9 may include a flexible portion 5 (FIG. 3) that extends downward to the ground to vacuum spoil material from the excavation site. The flexible portion 5 may be manipulated by a user to direct the vacuum suction toward the excavation site.

The vacuum system 7 acts to entrain the cut earth and the water used to excavate the site in a stream of air. A blower or vacuum pump 24 (FIG. 3) pulls a vacuum through the boom 9 to entrain the material in the airstream. Air is discharged from the blower 24 after spoil material is removed from the airstream.

The airstream having water and cut earth entrained therein is pulled through the boom 9 and through a series of conduits (e.g., conduit 47 shown in FIG. 9) and is pulled into a disentrainment system 46. In the embodiment illustrated in FIG. 3, the disentrainment system 46 includes a separation vessel 21, airlock 55 for discharging material from the separation vessel 21, one or more cyclones 11, one or more conveyors 80 for removing material from the cyclones 11 and a cyclone discharge pump 20. The disentrainment system 46 is an example system and, in accordance with other embodiments of the present disclosure, may include more or less processing units that are arranged in different configurations. Generally, any disentrainment system that removes earthen material from an airstream may be used unless stated otherwise. A pluggage prevention system 60 (FIG. 5) (which may also be referred to as a pluggage monitoring system) reduces build-up or plugging of spoil material in the disentrainment system 46 as further described below.

The disentrainment system 46 includes a separation vessel 21 and cyclones 11 for removing spoil material from the airstream. The separation vessel 21 is a first stage separation in which the majority of spoil material is removed from the airstream with carryover material in the airstream being removed by the cyclones 11 in a second stage (i.e., the separation vessel 21 is the primary separation vessel with the downstream cyclones 11 being secondary separation vessels).

Figure 7:
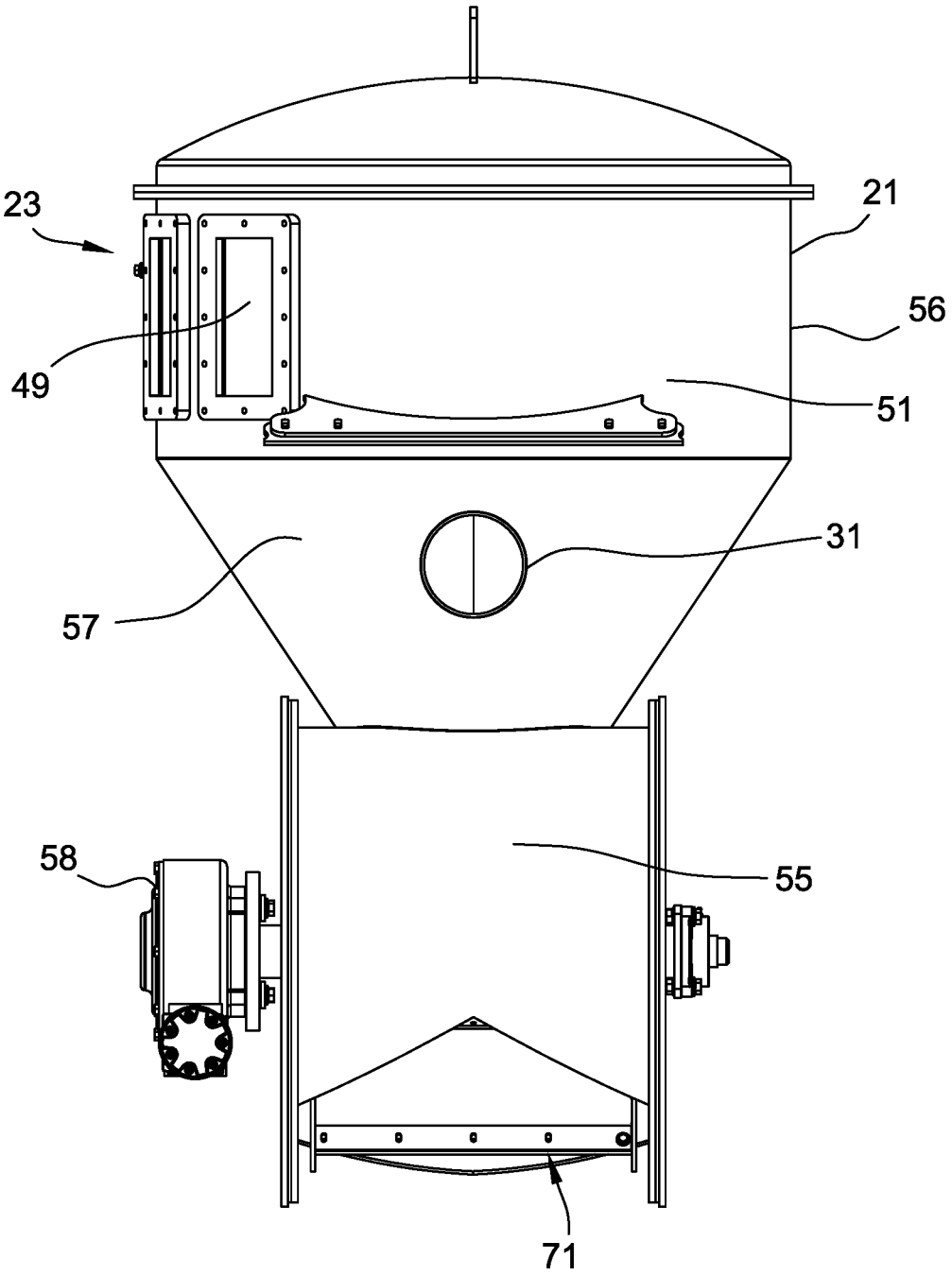
FIG. 7 is a front view of a separation vessel, shown as a deceleration vessel, and an airlock.

The separation vessel 21 (FIG. 7) removes at least a portion of cut earthen material and water from the airstream. Air exits one or more separation vessel air outlets 49 and is introduced into cyclones 11 (FIG. 2) to remove additional spoil material (e.g., water, small solids such as sand, low density particles such as sticks and grass, and the like) not separated in the separation vessel 21. Spoil material discharged from the bottom of the cyclones 11 is conveyed to a cyclone discharge pump 20 (FIG. 10) (e.g., peristaltic pump described in further detail below) and is introduced to the dewatering system 95 described below, or, alternatively, is gravity fed to the dewatering system 95. The air removed from the cyclones 11 is drawn through a vacuum tube 22 (FIG. 3) to be introduced into one or more filter elements 28 before entering the vacuum pump 24. The vacuum pump 24 may be disposed in or near the engine compartment 26 (FIG. 2). Air is removed from the apparatus through a vacuum exhaust 29.

The vacuum pump 24 generates vacuum in the system to pull water and cut earthen material into the excavation apparatus for processing. In some embodiments, the vacuum pump 24 is a positive displacement pump. Such positive displacement pumps may include dual-lobe or tri-lobe impellers (e.g., a screw rotor) that draw air into a vacuum side of the pump and forces air out the pressure side.

Figure 8:
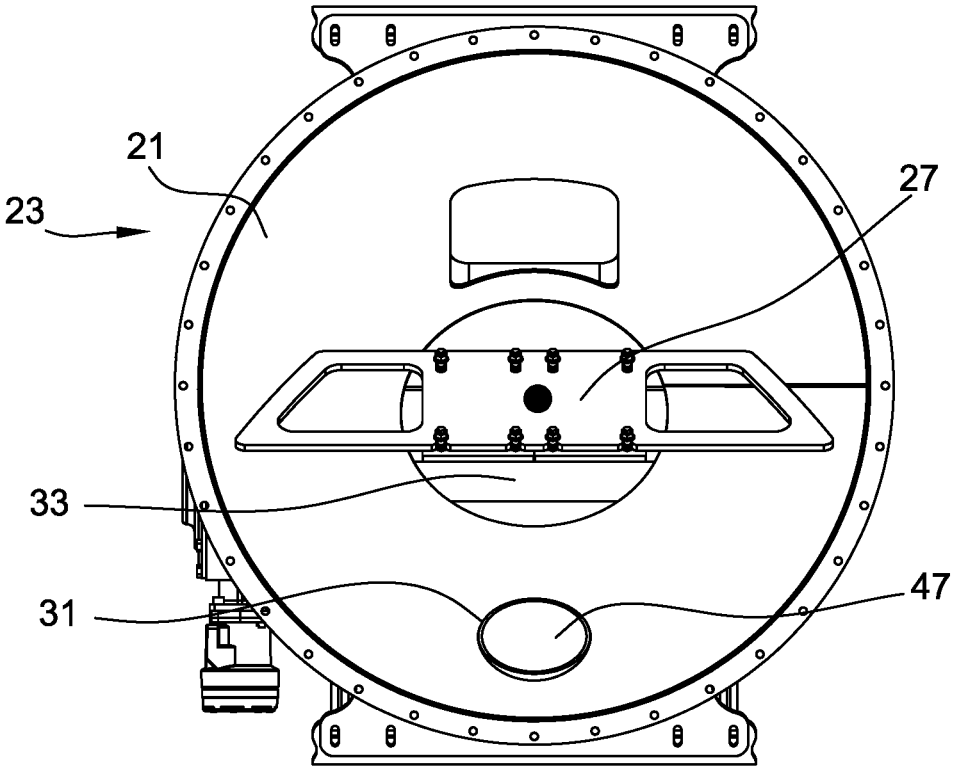
FIG. 8 is a top view of the deceleration vessel and a deflection plate.
Figure 9:
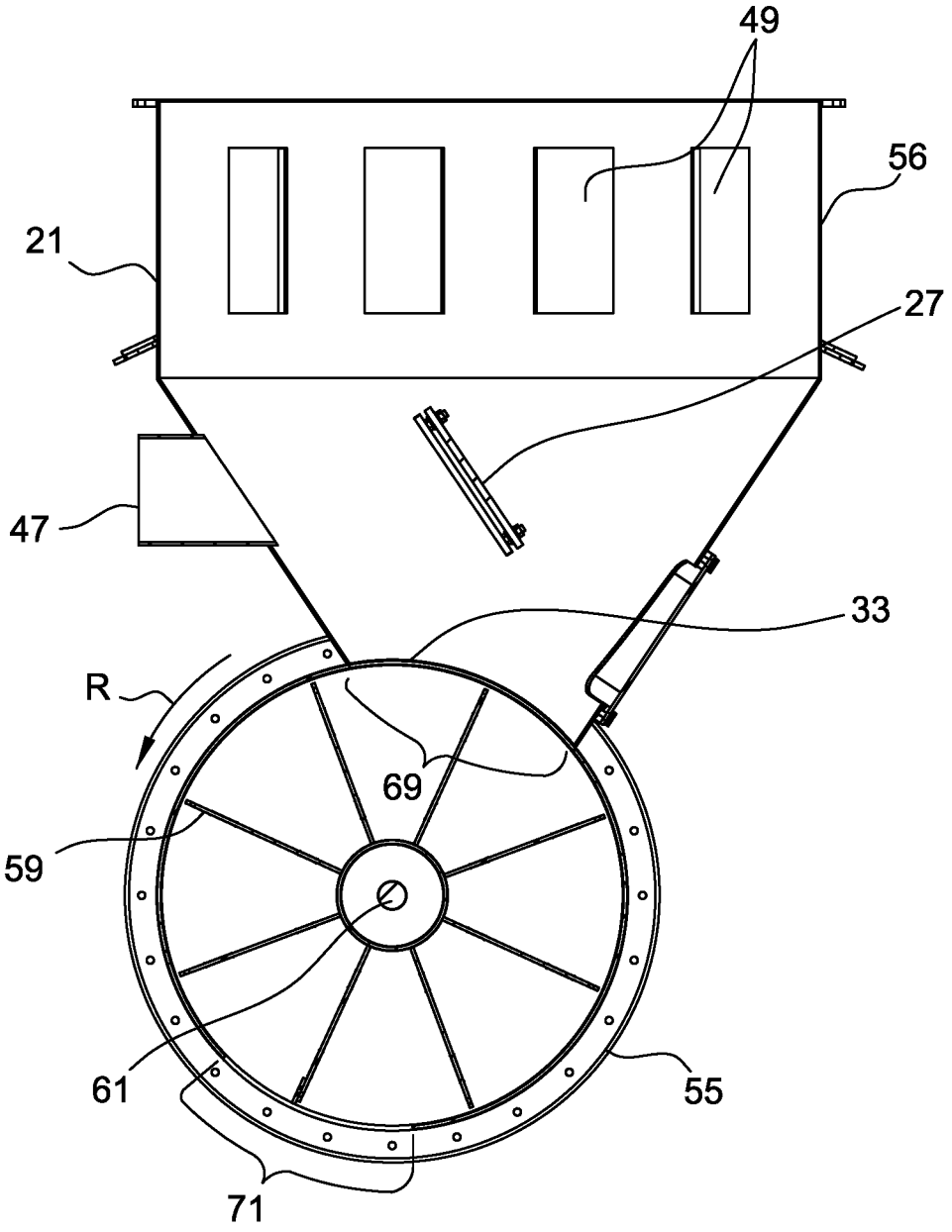
FIG. 9 is a side view of the deceleration vessel and airlock.

Spoil material containing water and cut earth is introduced into the separation vessel 21 through inlet conduit 47 (FIG. 9). At least a portion of spoil material falls from the airstream to a spoil material outlet 33 (FIG. 8) and into an airlock 55. Air removed through air outlets 49 is processed in cyclones 11 (FIG. 2) to remove at least a portion of carryover spoil material.

Figure 3:
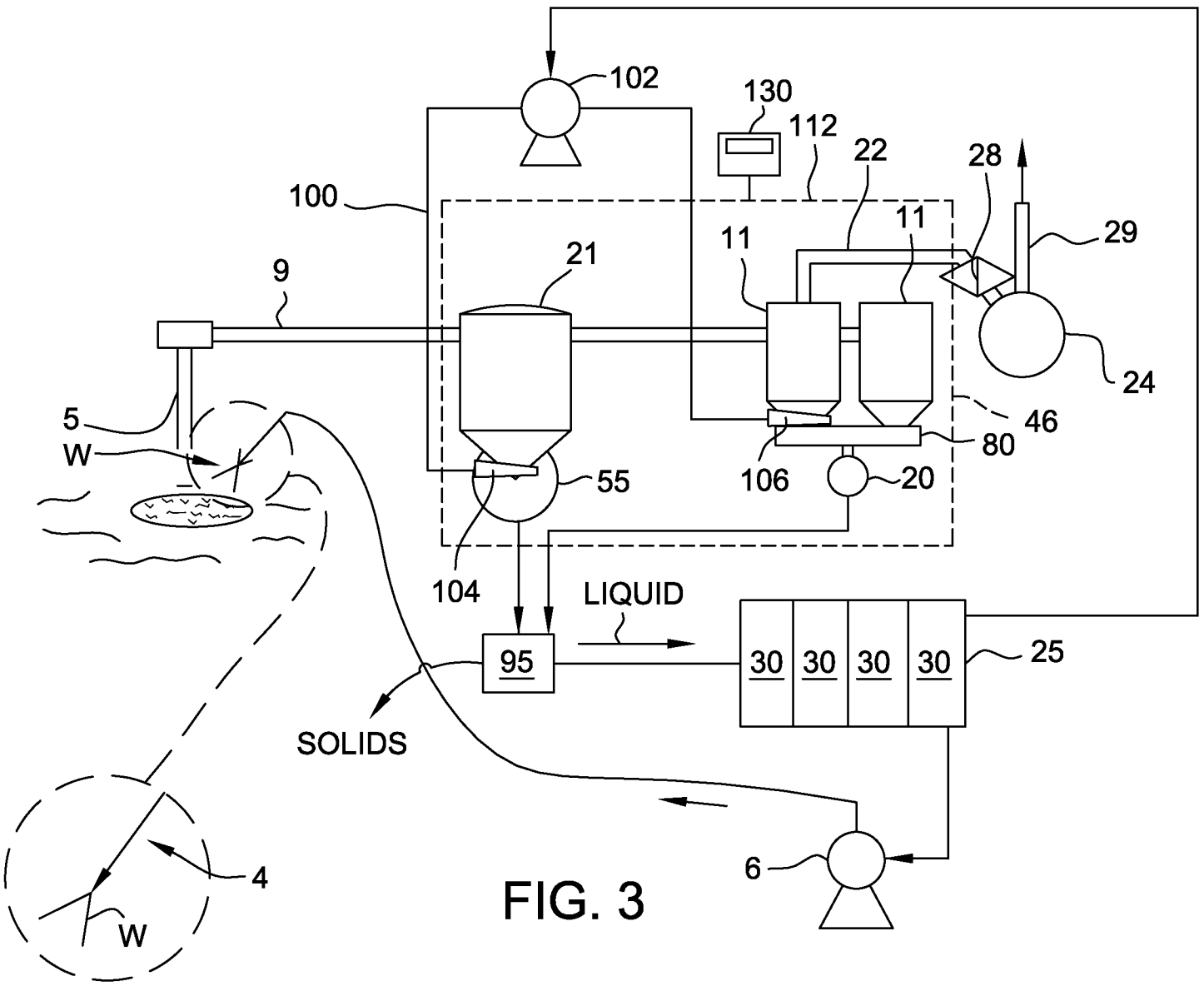
FIG. 3 is a schematic of water and air flow in the excavation vacuum apparatus.
Figure 4:
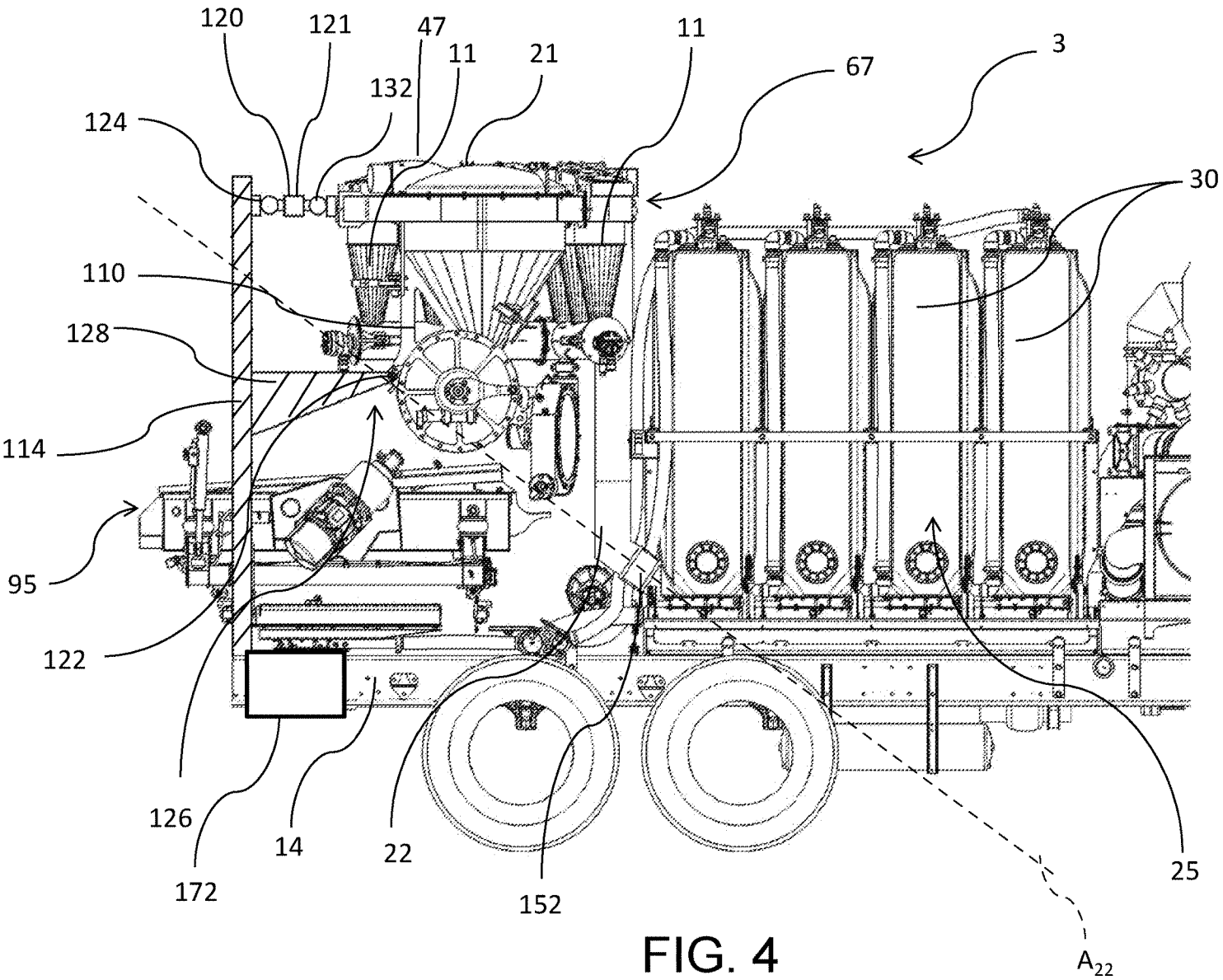
FIG. 4 is a partial side view of the excavation vacuum apparatus showing the disentrainment system.
Figure 10:
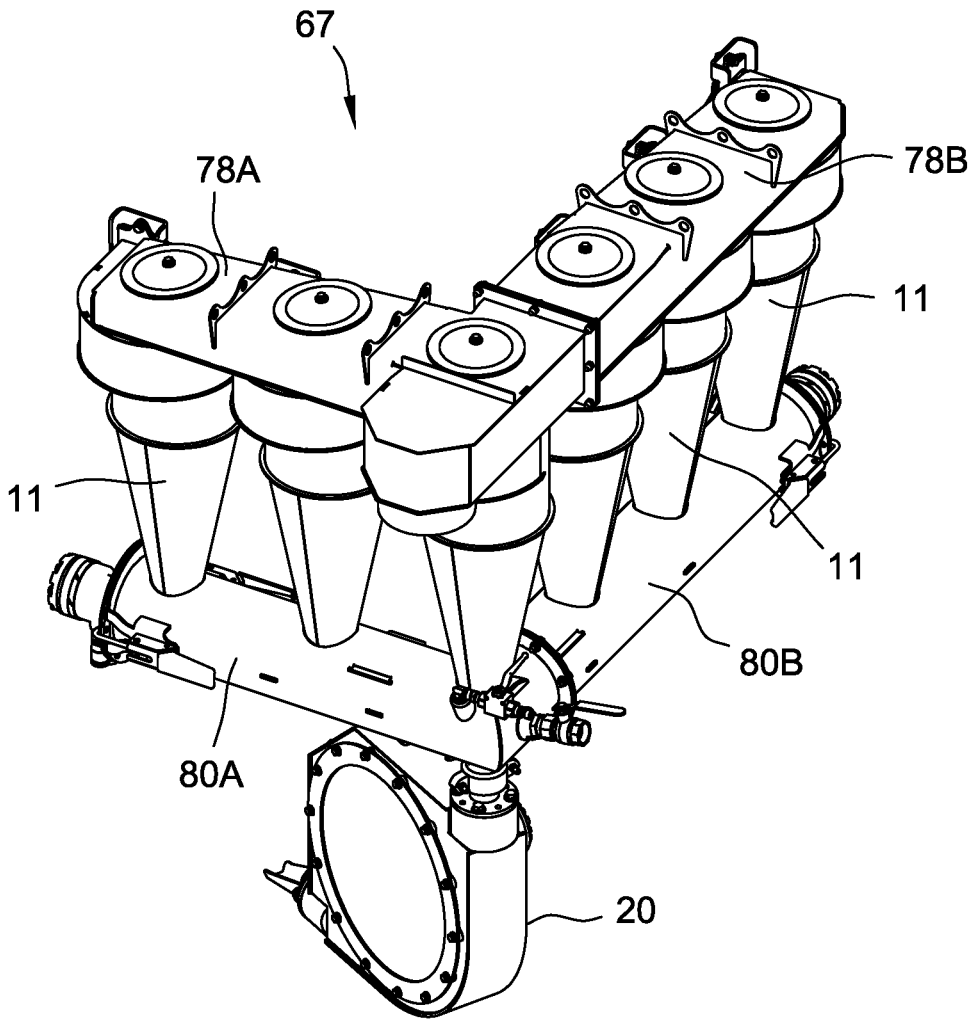
FIG. 10 is a perspective view of a cyclonic separation system of the excavation vacuum apparatus.

The cyclones 11 may be part of a cyclonic separation system 67 (FIG. 4). The cyclones 11 receive airflow from the separation vessel 21. Cyclonic action in the cyclones 11 causes entrained spoil material to fall to the bottom of the cyclones 11 and into conveyors 80A, 80B (FIG. 10). Air pulled through the cyclones 11 is discharged through cyclone discharge manifolds 78A, 78B and is directed to one or more filter elements 28 (FIG. 3) before entering the vacuum pump 24 (FIG. 3).

The conveyors 80A, 80B are sealed to reduce or prevent air from entering the vacuum system through the conveyors 80A, 80B (e.g., having gaskets or bearings or the like that seal the conveyor from the ambient atmosphere). The conveyors 80A, 80B may be screw conveyors (e.g., an auger) having a rotating screw therein. The screw conveyor may be a centerless screw conveyor. In other embodiments, the screw conveyor may include a center shaft. In yet other embodiments, the one or more conveyors 80 may be slat conveyors, belt conveyors or rotary vane conveyors. In other embodiments, the conveyors 80A, 80B are eliminated (e.g., replaced with one or more airlocks). The conveyors 80 are powered by motors which may be quick-attach motors to facilitate clean-out of the conveyors 80. The cyclonic separation system 67 may generally include any number of cyclones 11 and conveyors 80. The conveyors 80 convey material to the cyclone discharge pump 20. The cyclone discharge pump 20 may be sealed and configured to prevent air entry during discharge of spoil material.

The excavation apparatus 3 includes a spray nozzle system 100 (FIG. 3) that may be used to clear a spoil build-up in one or more of the components of the disentrainment system 46. The spray nozzle system 100 directs pressurized water towards one or more of the components of the disentrainment system 46 in order to break apart a spoil build-up.

The spray nozzle system 100 may include a spray pump 102 that is used to provide pressurized water to the spray nozzles assemblies 104, 106. In some example embodiments, the spay pump 102 may be the excavation fluid pump 6 that supplies water to the wand 4. In other embodiments, the spray nozzles assemblies 104, 106 may be supplied with pressurized water through a separate spray pump dedicated to provide pressurized water to one or more of the spray nozzle assemblies 104, 106.

In this illustrated embodiment, the spray nozzle system 100 includes a first spray nozzle assembly 104 and a second spray nozzle assembly 106. The first spray nozzle assembly 104 is arranged to add spray water to airlock 55 and/or the separation vessel 21, such that the first spray nozzle assembly 104 may be use to clear a spoil build-up within at least one of the separation vessel 21 and/or the airlock 55. The second spray nozzle assembly 106 may provide spray water to the cyclones 11 and/or the conveyors 80. As such, the second spray nozzle assembly 106 may be use to clear or break apart a spoils build-up within at least one or more of the cyclones 11 and/or the conveyors 80. In other example embodiments, the excavation apparatus 3 includes additional or different spray nozzle assemblies that may be used to clear a spoil build-up in one or more components of the disentrainment system 46.

The spray nozzle assemblies 104, 106 may be stationary such that the pressurize water expelled from a the spray nozzle assembly 104, 106 is directed towards a relatively fixed position within the disentrainment system 46. In alternative example embodiments, an operator may adjust the direction of the pressurized water by adjusting the position of the spray nozzle assemblies 104, 106. For example, an operator may selectively adjust the position of the spray nozzle assemblies to redirect the direction of the pressurized water. In other example embodiments, the position of the spray nozzle assemblies 104 may be adjusted via a motorized system, such as a robotic system.

One or more of the components of the disentrainment system 46 are coupled to a disentrainment system frame 110 (FIG. 4). The disentrainment system frame 110 supports the separation vessel 21, airlock 55, conveyors 80, cyclones 11, and pump 20. The components supported by the disentrainment system frame 110 may be collectively referred to herein as the weighed separation system 112 (shown in FIG. 3). In other example embodiments, different or additional components of the excavation apparatus 3 (e.g., the disentrainment system 46) may be mounted to the disentrainment system frame 110. In some embodiments, the entire disentrainment system 46 is weighed (i.e., is the weighed system 112) and, in other embodiments, only a portion of the disentrainment system 46 is weighed (i.e., is part of the weighed system 112). The weighed system 112 may be coupled to the disentrainment system frame 110 by any means, for example and without limitation, bolts, rivets, and/or welded connections.

In this illustrated embodiment, the disentrainment system frame 110 is coupled to a mounting frame 114 (FIG. 4), such that the mounting frame 114 supports the disentrainment system frame 110 and likewise any component coupled to the disentrainment system frame 110. The mounting frame 114 is coupled to the chassis 14 of the excavation apparatus 3.

The disentrainment system frame 110 is connected to the mounting frame 114 at one or more joints. In this illustrated embodiment, the disentrainment system frame 110 is supported by the mounting frame 114 at two joints, a first joint 120 and a second joint 122. The second joint 122 is a rotational joint which allows the disentrainment system frame 110 to rotate relative to the mounting frame 114 about an axis parallel to the chassis 14 and substantially parallel to axis B (i.e., the disentrainment system 46 is suspended from the second joint 122 such that the weight of the disentrainment system 46 causes the first joint 120 to be in tension). The first joint 120 is used to support a sensor 121 mounted between the mounting frame 114 and the disentrainment system frame 110. In this dual support configuration, changes in weight of the disentrainment system 46 causes a parameter at the first joint 120 measured by the sensor 121 to be altered (i.e., changes in forces and/or moments experienced by the sensor 121 at the first joint 120).

The disentrainment system frame 110 is supported by the mounting frame 114 such that the center of weight of the disentrainment system 46 is located a distance away from the second joint 122. As such, the weight of the weighed system 112 and/or the weight of the separation system frame may generate a moment about the second joint 122. Additionally and/or alternatively, changes in the weight of the weighed disentrainment system 112 may increase or decrease the moments about the second joint 122. More specifically, spoil build-up within one or more components of the weighed disentrainment system 112 may increase the moment about the second joint 122.

Figure 13:
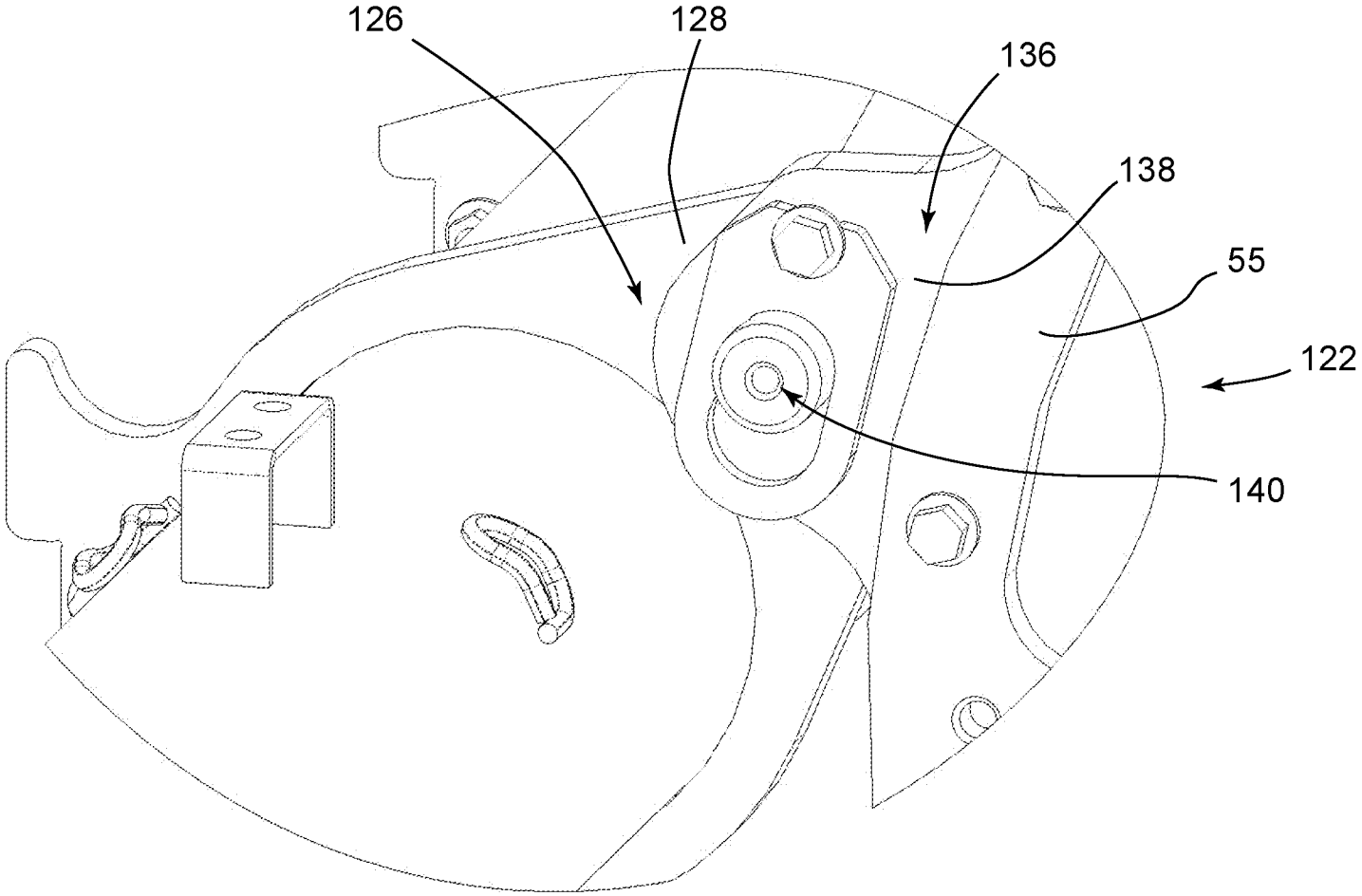
FIG. 13 is a photo of a joint at which a disentrainment system of the excavation vacuum apparatus connects to a mounting frame.

The mounting frame 114 includes a first sensor mount 124 and a mounting frame lower mount 126 that connect the disentrainment system frame 110 to the mounting frame. The mounting frame lower mount 126 may include a hinge pin 140 (FIG. 13) that extends through two brackets (one bracket 128 being shown in FIGS. 4 and 13). The disentrainment system 46 includes a disentrainment system lower mount 136. In the illustrated embodiment, the disentrainment system lower mount 136 includes two lobes (first lobe 138 shown in FIG. 13) that extend from the airlock 55. The disentrainment system lower mount 136 is free to move (i.e., pivot) about the hinge pin 140 such that the weighed system 112 of the disentrainment system 46 are suspended from the mounting frame 114 at the second joint 122.

The disentrainment system frame 110 includes a second sensor mount 132. More specifically, at the first joint 120, the sensor 121 is mounted between the first sensor mount 124 coupled to the mounting frame 114 and the second sensor mount 132 coupled to the disentrainment system frame 110. In the illustrated embodiment, the sensor 121 is a load cell sensor. The load cell sensor 121 may be used to detect at least one or more of force in tension and/or compression and/or a bending moment at the first joint 120.

In should be understood that, if not mitigated, the vacuum pressure within the vacuum tube 22 may induce additional forces and/or moments on the disentrainment system 46 thereby affecting the force/torques experienced at least one of the first joint 120 and/or the second joint 122. In some embodiments, the vacuum tube 22 is arranged such that a vacuum force induces minimal and/or reduced forces on the first joint 120. In the illustrated embodiment, the vacuum tube 22 includes a flexible segment 152. The flexible segment 152 is arranged such that the vacuum force is directed along an axis $A_{22}$ that passes near or through the second joint 122, such that the vacuum force does not generate a significant moment about the second joint 122.

The various hoses and connections (e.g., vacuum tube 22 from cyclones 11 to the vacuum pump 2, connection of boom 9 to the inlet of the separation vessel 21 and the like) may have one or more isolating or "damping" sections (e.g., flexible and/or rubber joints). Such damping sections reduce the forces transmitted through such hoses and connections being further transmitted to the weighed system 112. This improves the accuracy of the sensor 121. Additionally, weight changes created by various other connections between the weighed system 112 and other components of the apparatus 3 (e.g., water hoses, hydraulic hoses, electrical wires) can be accounted for during calibration or are negligible.

The excavation apparatus includes a sensor system 130 (FIG. 5) that detects a spoil build-up within one or more components of the disentrainment system 46. The sensor system 130 and controller 150 described below may be part of a pluggage prevention system 60 (FIG. 5) to prevent the disentrainment system 46 from becoming plugged or occluded with earthen material.

The pluggage prevention system 60 may generally include any sensor system 130 that is capable of detecting a spoil build-up unless stated otherwise. In the illustrated embodiment, the sensor system 130 includes the load cell 121 used to detect the weight of one or more components of the disentrainment system 46 and/or the weight of the spoil material contained within the components of the disentrainment system 46. In other example embodiments, the sensor system 130 includes one or more additional sensors. For example, in some alternative embodiments, the sensor system 130 includes one or more of a flow meter. The one or more flow meters may be used to detect the mass flow from entering into the disentrainment system and to detect the mass flow exiting the system. Additionally or alternatively, the sensor system 130 may include one or more of an ultrasound sensor that may be used to detect spoil build-up within the disentrainment system. In other embodiments, the sensor system 130 may include additional or alternative sensors that enable the disentrainment system to function as described herein.

Figure 5:
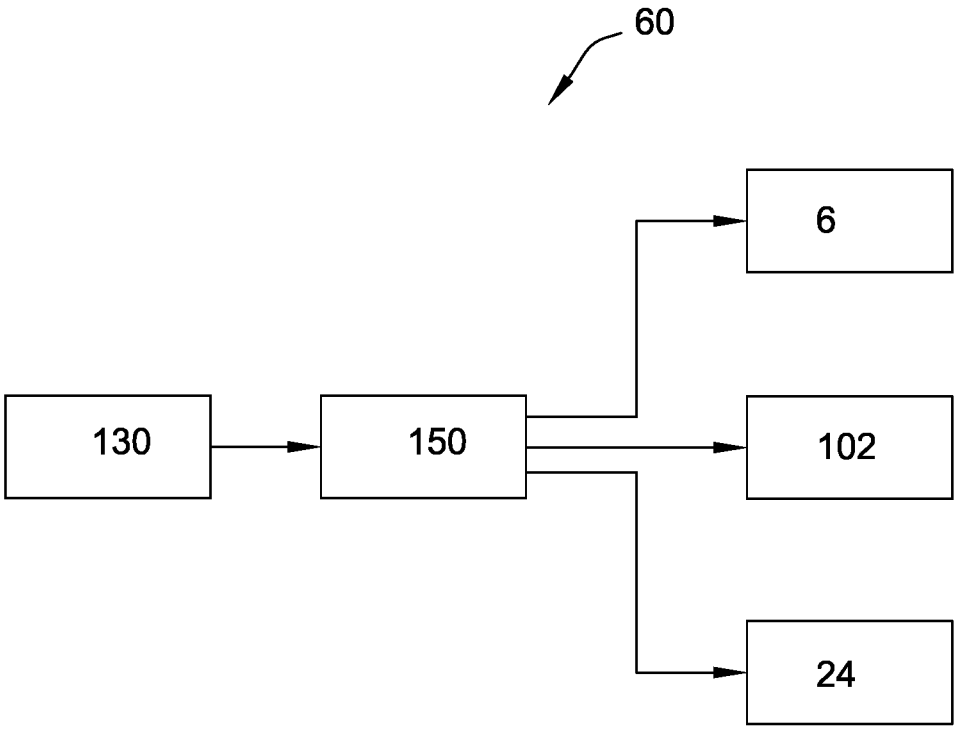
FIG. 5 is a block diagram of a system for reducing or preventing pluggage of spoil material in the excavation vacuum apparatus.

The one or more sensors of the sensor system 130 produce a signal that is transmitted to a disentrainment controller 150 (FIG. 5). The disentrainment controller 150 may control additional aspects of the excavation apparatus 3 (e.g., controlling the flow of liquids in the fluid storage and supply system 25) or a dedicated controller may be used. The disentrainment controller 150 monitors the disentrainment system 46 for spoil build-up and/or pluggage within one or more components of the disentrainment system 46. The disentrainment controller 150 is communicatively coupled to the sensor system 130.

In the illustrated excavation apparatus 3, the load cell sensor 121 transmits a signal to the controller 150 indicating the amount of force and/or torque experienced by the load cell sensor 121 at the first joint 120. As described above, the load cell sensor 121 measures forces and/or torques associated with the combined weight of spoil material contained within the weighed system 112 of the disentrainment system 46. In this illustrated embodiment, the load cell sensor 121 measures a force and/or a torque associated with the total combined weight of the weighed system 112 (e.g., cyclones 11, the separation vessel 21, the airlock 55, the conveyor 80, the peristaltic pump 20) and any spoil material contained in any of these units.

The controller 150 is communicatively coupled to the spray pump 102 and/or valving between the pump 102 and the nozzle assemblies 104, 106 such that the controller 150 may selectively power the spray pump 102 to selectively provide pressurized water to the first spray nozzle assembly 104 and/or the second spray nozzle assembly 106. The controller 150 controls the spray pump 102 based on instructions stored in a memory device (not shown), inputs received from the load cell sensor 121, inputs from a user via a user interface 160 (described below), and/or input received from any other suitable data source.

Disentrainment controller 150, the various logical blocks, modules, and circuits described herein may be implemented or performed with a general purpose computer, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. Example general purpose processors include, but are not limited to, microprocessors, conventional processors, controllers, microcontrollers, state machines, or a combination of computing devices.

Disentrainment controller 150 includes a processor, e.g., a central processing unit (CPU) of a computer for executing instructions. Instructions may be stored in a memory area, for example. Processor may include one or more processing units, e.g., in a multi-core configuration, for executing instructions. The instructions may be executed within a variety of different operating systems on the controller, such as UNIX, LINUX, Microsoft Windows®, etc. It should also be appreciated that upon initiation of a computer-based method, various instructions may be executed during initialization. Some operations may be required in order to perform one or more processes described herein, while other operations may be more general and/or specific to a particular programming language e.g., and without limitation, C, C #, C++, Java, or other suitable programming languages, etc.

Processor may also be operatively coupled to a storage device. Storage device is any computer-operated hardware suitable for storing and/or retrieving data. In some embodiments, storage device is integrated in controller. In other embodiments, storage device is external to controller and is similar to database. For example, controller may include one or more hard disk drives as storage device. In other embodiments, storage device is external to controller. For example, storage device may include multiple storage units such as hard disks or solid state disks in a redundant array of inexpensive disks (RAID) configuration. Storage device may include a storage area network (SAN) and/or a network attached storage (NAS) system.

In some embodiments, processor is operatively coupled to storage device via a storage interface. Storage interface is any component capable of providing processor with access to storage device. Storage interface may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor with access to storage device.

Memory area may include, but are not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are exemplary only, and are thus not limiting as to the types of memory usable for storage of a computer program.

Figure 12:
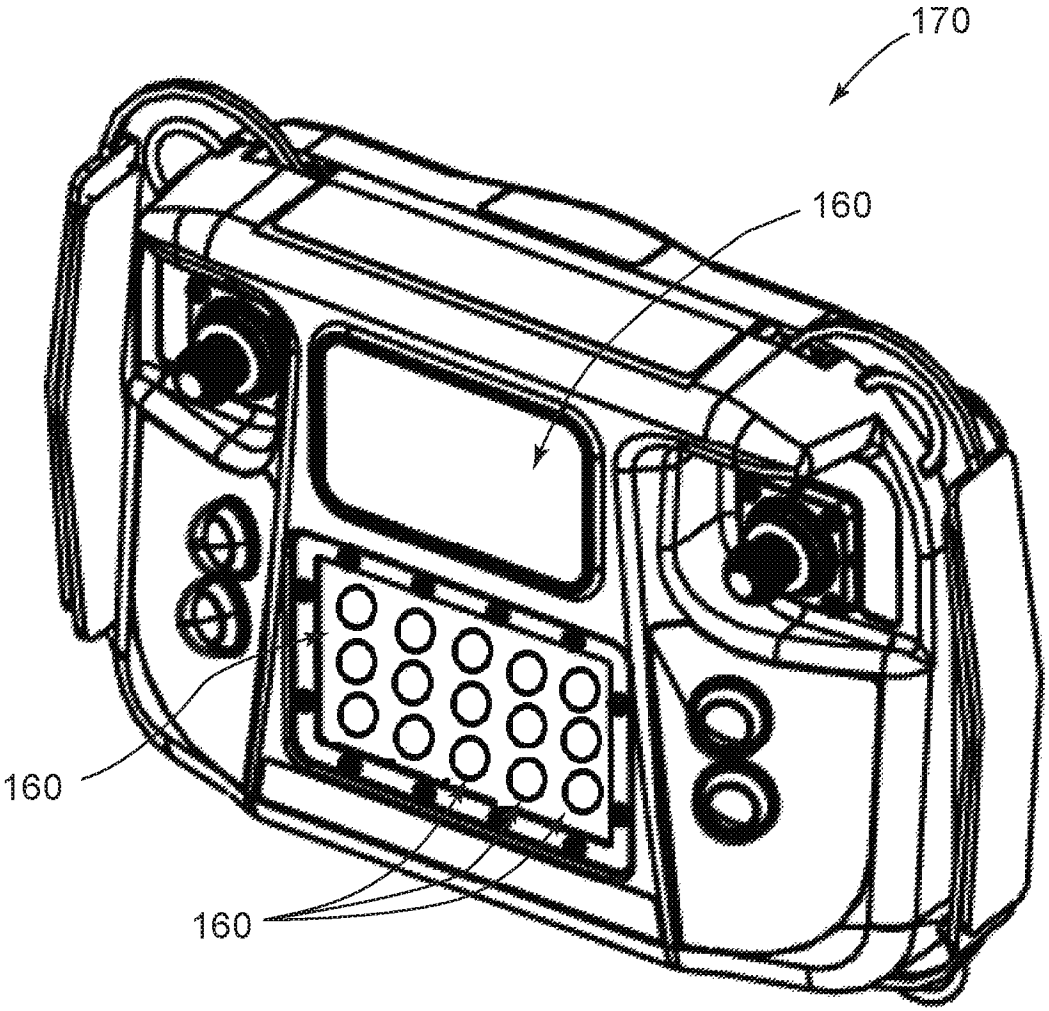
FIG. 12 is a front view of a remote console supporting a user interface of the excavation vacuum apparatus.

The excavation apparatus 3 may further include one or more user interfaces 160 (FIG. 12) to allow an operator to communicate with one or more components of the excavation apparatus and the disentrainment controller 150. The user interface 160 may be supported by a remote console 170 (shown in FIG. 12) and/or a stationary console 172 (FIG. 4). The stationary console 172 may be integral to the excavation apparatus 3, i.e., the console may be mounted to the chassis 14. The remote console 170 allows an operator to remotely control the operation of the excavation apparatus 3. The remote console 170 may communicate with the disentrainment controller 150 by a communication link that does not include a wire, such as a radio communication link. Additionally or alternatively, the user interface 160 is communicatively coupled with the disentrainment controller 150 such that an operator may override operations executed by the disentrainment controller 150.

The user interface 160 may include any additional control devices used to control or operate a function of the vehicle, for example and without limitation, the user interface 160 may include buttons, knobs, and/or switches that may be used to start or stop one or more of the excavation fluid pump 6, vacuum pump 24 and spray pump 102. The user interface 160 may further include a display screens and/or gauges used to provide feedback to the operator. The user interface 160 may also include decals, for example, images and/or instructions that may be interpreted by an operator.

After initiation of a separation operation in the excavation apparatus 3, spoil material is drawn into the separation vessel 21 by the vacuum airstream where at least a portion of the spoil material is separated from the airstream and discharged via the airlock 55. Any carryover spoil material is passed onto the cyclones 11 where additional spoils are separated from the airstream and discharged from the system via the conveyors 80. As such, during a normal separation operation, at least some spoil material is contained within the components of the disentrainment system 46 as spoil material passes between each component. During a normal separation operation, the load cell sensor 121 may measure an operating weight of the disentrainment system 46. This weight may be compared to a tare weight that includes the empty weight of the weighed system 112 of the disentrainment system 46 (i.e., the tare weight subtracted from the operating weight) to determine a spoil material weight. The tare weight corresponds to the empty weight of the weighed system 112 (before operation or when a vacuum is applied to the system without processing earthen slurry). The tare weight may be pre-set (e.g., factory set). In some embodiments, the tare weight may be recalibrated when desired such as when the empty weight of the weighed system 112 is changed (e.g., service work, replacing components, and/or by substitution of different vacuum hoses or the like).

An operating weight is measured (by the sensor 121 which produces a signal that is correlated to a weight or from which a weight is calculated) while excavating a site with the excavation apparatus 3. A spoil material weight is calculated by subtracting the tare weight from the operating weight. When the spoil material weight exceeds one or more thresholds, the pluggage prevention system 60 may begin one or more mitigation operations as described below.

Figure 6:
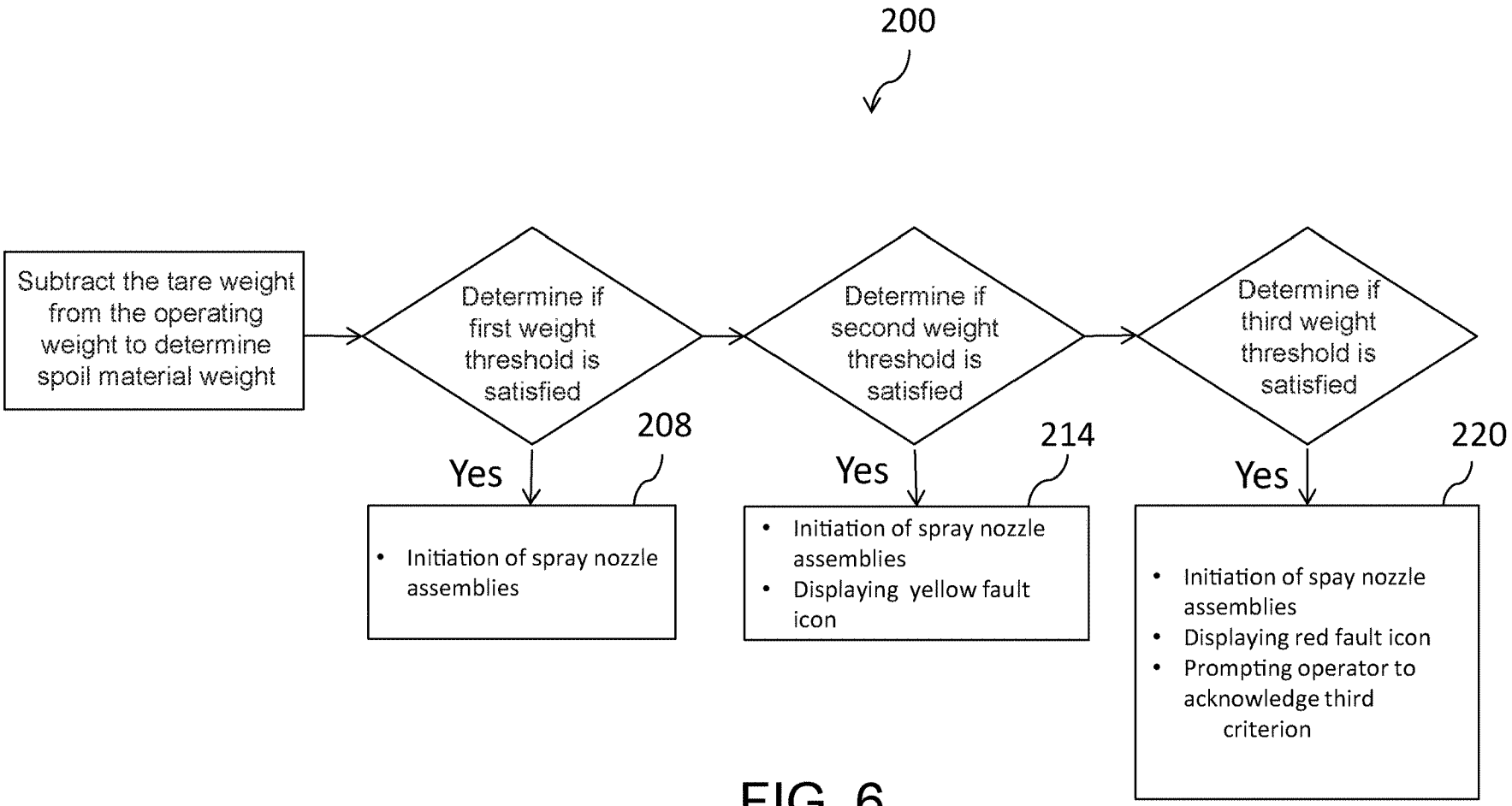
FIG. 6 is a block diagram of a clearing module of the pluggage monitoring system of the excavation vacuum apparatus.

As shown in FIG. 6, the disentrainment controller 150 includes a clearing module 200 for clearing a spoil build-up within the disentrainment system 46. The clearing module 200 includes a set of instructions that may be executed by the disentrainment controller 150. The clearing module 200 includes one or more weight thresholds or "criterions" and one or more clearing operations. The disentrainment controller 150 may monitor a signal from the load cell sensor 121 in order to determine if a threshold is satisfied. In response to one or more of the thresholds being satisfied, the disentrainment controller 150 may execute one or more of the clearing operations.

The clearing module 200 includes determining a spoil material weight by subtracting the tare weight from the operating weight of the weighed system 112 during a separation operation. The disentrainment controller 150 receives a plurality of signals from the load cell sensor 121 after initiation of excavation. In some embodiments, the disentrainment controller 150 may average the operating weight of the weighed system 112 of the disentrainment system 46 over a period of time to determine the operating weight.

The clearing module 200 includes a first clearing operation 208. The first clearing operation 208 is activated when the first weight threshold is reached. The first weight threshold (and second and third thresholds discussed below) may be selected based on the size of the system, types of material being processed and ability of the system to process surges of earthen material. Generally, the first, second and third weight thresholds are pre-set (e.g., factory pre-set).

If the disentrainment controller 150 determines 206 that the first weight threshold is satisfied, the disentrainment controller 150 executes the first clearing operation 208. In the first clearing operation 208, the disentrainment controller 150 transmits a signal to the spray pump 102 such that pressurized water is provided to the first spray nozzle assembly 104 and/or the second spray nozzle assembly 106. The first clearing operation 208 may include supplying pressurized water to the spray nozzle assemblies 104, 106 at a cyclic pace such that the spray pump 102 is cycled between being powered on for an amount of time and powered off for another amount of time. In this example embodiment, the disentrainment controller 150 powers the spray pump 102 for two revolutions or the airlock and then turns the spray pump 102 off for an amount of time, for example and without limitation, 5 minutes. The disentrainment controller 150 may execute this cycle for a plurality of times until the spoil build-up is cleared. More specifically, the disentrainment controller 150 may continuously execute the first clearing operation 208 until the spoil material weight falls below the first threshold amount.

The clearing module further includes a second clearing operation 214 that is activated when a second spoil material weight threshold is met (i.e., a weight threshold that exceeds the first weight threshold). If the disentrainment controller 150 determines that the second weight threshold is satisfied, the disentrainment controller 150 executes a second clearing operation 214. The disentrainment controller 150 may execute the second clearing operation 214 by transmitting a signal to the spray pump 102 such that pressurized water is provided to at least one of the first spray nozzle assembly 104 and/or the second spray nozzle assembly 106. Additionally, the disentrainment controller 150 may transmit a signal to the user interface 160, such that a warning signal may indicate to the operator that a spoil build-up is occurring within the disentrainment system 46. For example, the user interface 160 may illuminate a yellow fault icon on a screen. In the second clearing operation 214 the controller may transmit a signal to turn off the excavation fluid pump 6 to terminate expulsion of high-pressure water from the wand 4 (FIG. 3). Additionally or alternatively, in the second clearing operation 214 the controller 150 transmits a signal to turn off the vacuum pump 24. During the second clearing operation 214, the operator may choose to override the fault with remote console 170 or the on-board, stationary console 172 (FIG. 4) to restart the excavation fluid pump 6 and/or the vacuum pump 24.

The clearing module also includes a third clearing operation 220. The third clearing operation 220 is activated upon a third spoil weight threshold being met (i.e., a spoil material weight that exceeds the first and second thresholds). The disentrainment controller 150 executes the third clearing operation 220 by transmitting a signal to the spray pump 102 such that pressurized water is provided to at least one of the first spray nozzle assembly 104 and/or the second spray nozzle assembly 106. Additionally or alternatively, the disentrainment controller 150 transmits a signal to the user interface 160 such that a warning signal is displayed to be interpreted by an operator. For example, a red fault icon is illuminated on the user interface 160.

In the third clearing operation 220, the disentrainment controller 150 initiates a shutdown operation. For example, in the third clearing operation 220, the controller transmits a signal to turn off the excavation fluid pump 6 and, optionally, the vacuum pump 24 to terminate excavation. In some embodiments, during the third clearing operation 220, the operator may be limited to overriding the fault by interacting with the onboard console 172 (FIG. 4) to restart the excavation fluid pump 6 and/or the vacuum pump 24, and functionality of the remote console 170 is limited. In some embodiments, if the fault is over-ridden during the third clearing operation 220, the amount of time the excavation fluid pump 6 and/or vacuum pump 24 may operate may be limited until the weight of weighed system 112 drops below the third threshold.

An operator may wish to over-ride the shutdown operation, i.e., the operator may wish to power the excavation fluid pump 6 and/or vacuum pump 24. In some embodiments, the disentrainment controller 150 transmits a signal to the user interface 160 such that an operator is prompted to acknowledge a warning signal prior to allowing the operator to override the shutdown operation. More specifically, the operator may be prompted to adjust at least one of a control device on the user interface 160 such that a signal is transmitted to the disentrainment controller 150 indicating that the operator is aware of the blockage. For example, after a shutdown operation the vacuum pump 24 may be shut off. Prior to allowing an operator to turn back on the vacuum pump 24, the operator may need to activate a button on the user interface 160 to acknowledge the spoil build-up.

The disentrainment controller 150 continuously monitors the weight of the weighed system 112 of the disentrainment system 46 to calculate a spoil material weight within the weighed system 112. Increases in the spoil material weight indicate that that spoils are building up within one or more units of the disentrainment system 46. Further, the magnitude of the spoil material weight indicates the severity of the spoil build-up, i.e., the greater the spoil material weight, the greater the amount of spoils accumulating within the disentrainment system 46. Further, the disentrainment controller 150 may initiate a clearing operation based on the monitored weight. The clearing operation may be tailored in response to the weight of the weighed system 112. In other words, the greater the amount of spoils material within the disentrainment system 46, the more aggressive the clearing operation performed to help mitigate a cascading blockage of spoils.

It should be noted that the clearing module 200 shown in FIG. 6 is exemplary and may include additional and/or different clearing condition thresholds and/or clearing operations.

In some embodiments, the operator may input signals into the user interface 160 to override an operation executed by the disentrainment controller 150 by adjusting one or more control devices. For example, the operator may turn on and/or off one or more of the spray nozzle assemblies 104, 106. For example, during the first clearing operation, the disentrainment controller 150 transmits a signal to power the spray pump 102 to supply water to at least one of the first spray nozzle assembly 104 and/or the second spray nozzle assembly 106 for a clearing operation. The operator may override this clearing operation by adjusting one or more user inputs on the remote console 170 and/or the stationary console 17 to control the operation of the spray pump 102.

In some example embodiments, the warning signals may include additional or alternative signals that may be interpreted by an operator. For example, the warning signals may include an auditory signal. In other example embodiments, a parameter of the separation system may be displayed on the user interface 160. For example, a parameter associated with the weight of the spoil material that has built-up in the disentrainment system may be displayed for the operator.

It should be noted that, as an alternative to calculating a spoil material weight based on the operating weight minus the tare weight, the tare weight may be built into the various weight thresholds (i.e., the absolute weight of the system is compared to a threshold that has the tare weight built into the threshold).

The disentrainment system 46 generally is meant to continuously process material received in the system 46 without storing material such that the spoil material weight represents material that has built up in the system and may result in pluggage rather than material that is being stored in the system. The weighed system 112 does not include processing units for storing the spoil material (e.g., a spoil tank).

As noted above, the excavation system may include various separation devices and features of the example excavation system disclosed in U.S. Patent Publication No. 2019/0017243, entitled "Hydro Excavation Vacuum Apparatus and Fluid Storage and Supply Systems Thereof". For example, the separation vessel 21 includes an upper portion 51 (FIG. 7) having a sidewall 56 and one or more air outlets 49 formed in the sidewall 56. The vessel 21 includes a lower portion 57 that tapers to the spoil material outlet 33 (FIG. 8). In the illustrated embodiment, the lower portion 57 is conical. The inlet 31 extends through the conical lower portion 57. In other embodiments, the inlet extends through the upper portion 51.

In some embodiments, the disentrainment system 46 includes a single separation vessel 21 in the first stage removal of solids and water from the airstream. In other embodiments, two or more separation vessels 21 are operated in parallel in the first stage removal of solids and water from the airstream.

In the illustrated embodiment, the separation vessel 21 is a deceleration vessel in which the velocity of the airstream is reduced causing material to fall from the airstream toward a bottom of the separation vessel 21. The deceleration vessel 21 is adapted to allow material to fall from the airstream by gravity rather than by vortexing of air within the vessel 21. In some embodiments, the inlet 31 of the vessel 21 is arranged such that the airstream does not enter the vessel 21 tangentially. The deceleration system 23 also includes a deflection plate 27 (FIG. 8) disposed within the deceleration vessel 21. The deflection plate 27 is configured and positioned to cause spoil material entrained in the airstream to contact the plate 27 and be directed downward toward the spoil material outlet 33.

From the spoil material outlet 33, the spoil material enters the airlock 55 (FIG. 9) and is discharged from the disentrainment system 46. The airlock 55 includes a plurality of rotatable vanes 59 connected to a shaft 61. The vanes 59 rotate along a conveyance path in the direction shown by arrow R in FIG. 9. The shaft 61 is connected to a motor 58 (FIG. 7) that rotates the shaft 61 and vanes 59. The airlock 55 has an airlock inlet 69 through which material passes from the deceleration vessel 21 and an airlock outlet 71 through which water and cut earthen material are discharged.

In other embodiments, a separation vessel 21 using cyclonic separation (i.e., a cyclone) in which airflow travels in a helical pattern is used to remove material from the airstream in a first stage separation.

Figure 11:
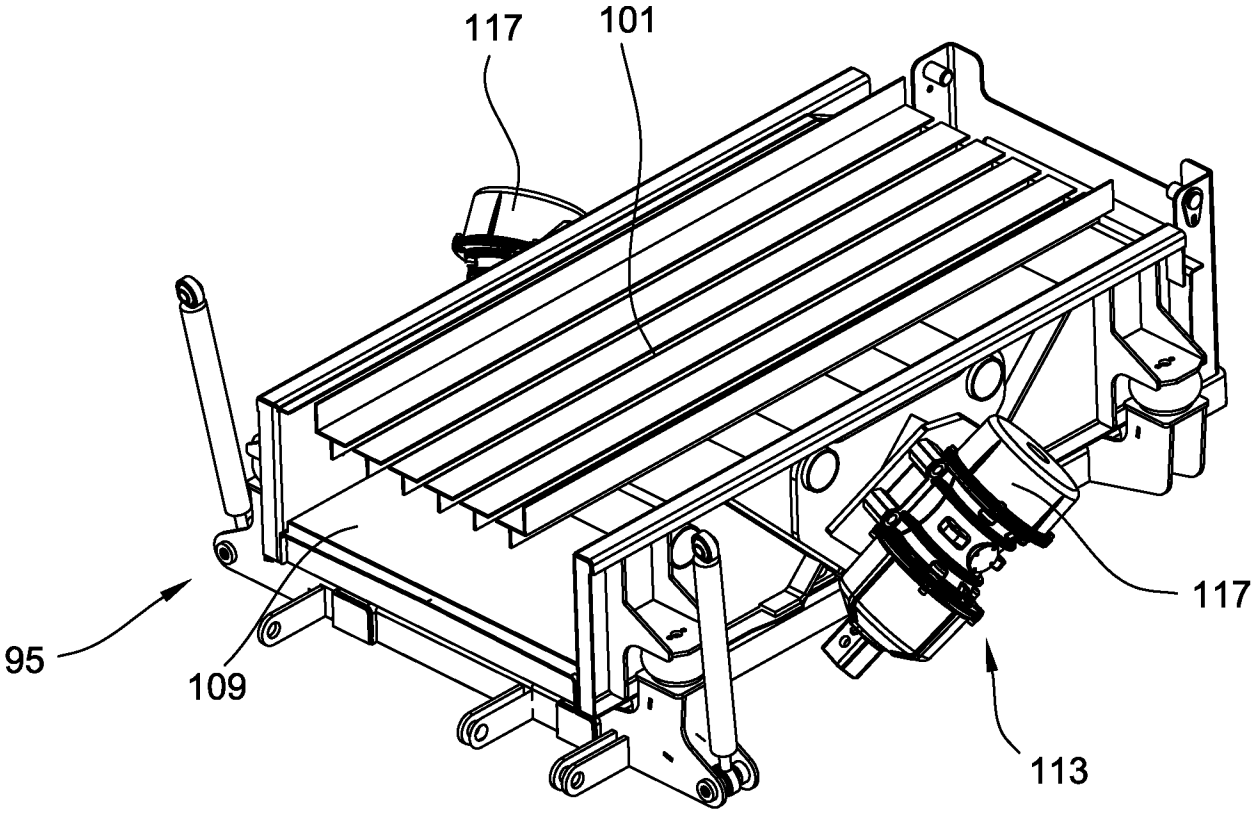
FIG. 11 is a perspective view of a dewatering system of the excavation vacuum apparatus.

In embodiments in which material is excavated by pressurized water, after discharge from the disentrainment system 46, the spoil material may be introduced into a dewatering system 95 (FIG. 11). The dewatering system 95 of some embodiments includes a pre-screen 101 that first engages material discharged from the outlet 71 of the airlock 55. The dewatering system 95 also includes a vibratory screen 109, more commonly referred to as a "shaker", that separates material that passes through the pre-screen 101 by size. The vibratory screen 109 may be part of a shaker assembly 113. The shaker assembly 113 includes vibratory motors 117 that cause the screen 109 to vibrate. As the screen 109 vibrates, effluent falls through openings within the screen 109 and particles that do not fit through the openings vibrate to the discharge end of the assembly 113. Solids that reach the discharge end fall into a hopper 125 (FIG. 1) and may be conveyed from the hopper 125 by a conveyor assembly 127 to form a stack of solids. Solids may be loaded into a bin, dumpster, loader bucket, ground pile, roll-off bin, dump truck or the like or may be conveyed to the site of the excavation as backfill. Solids may be transported off of the excavation apparatus by other methods. The dewatering system 95 of the present disclosure may include additional separation and/or purification steps for processing cut earthen material.

In may be noted that in some cases, a small portion of spoils may become trapped or caught in various locations within the components of the separation system 67, for example and without limitation, corners, edges, and the like, without significantly impeding a separation operation and/or clogging or plugging the components of the disentrainment system 46. In other words, a minimal amount of spoils may build-up within the spoil separation system 67 without significantly affecting the systems and methods disclosed herein. For example, in some cases, at least some material may build up on the one or more filter elements.

The hydro excavation vacuum apparatus 3 may include a fluid storage and supply system 25 which supplies water for high pressure excavation and stores water recovered from the dewatering system 95. The fluid storage and supply system 25 includes a plurality of vessels 30 for holding fluid.

Compared to conventional excavation apparatus, the apparatus of the present disclosure has several advantages. By monitoring the weight of the spoil material that builds-up in the disentrainment system of the apparatus, the system may be monitored to prevent pluggage. Build-up of spoil material may be mitigated by adding water to the system to help process material through the disentrainment system. The pluggage prevention system may disable excavation to prevent further spoil materials from building up in the system. In this manner, pluggage of the system may be avoided which increases the run-time of the apparatus. The pluggage prevention system may warn the operator that the system is nearing a pluggage condition to allow the operator to change operation of the system.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A mobile excavation vacuum apparatus comprising:

a vacuum system for removing spoil material from an excavation site by entraining the spoil material in an airstream;

a separation vessel for removing spoil material from the airstream, the separation vessel having an airlock at a first outlet through which spoil material is discharged from the separation vessel;

a cyclone for removing spoil material from the airstream, the cyclone having a cyclone discharge pump at a second outlet through which spoil material is discharged from the cyclone;

a pluggage monitoring system comprising a sensor system for measuring the weight of the separation vessel, the cyclone, and the spoil material within the separation vessel and the cyclone;

a chassis that supports the mobile excavation apparatus; and one or more wheels mounted to the chassis.

2. The mobile excavation vacuum apparatus as set forth in claim 1 wherein the pluggage monitoring system comprises a controller for receiving a signal from the sensor system to determine a measured weight of the separation vessel, the cyclone, and the spoil material within the separation vessel and the cyclone, the controller configured to compare the measured weight to a threshold weight.

3. The mobile excavation vacuum apparatus as set forth in claim 2 wherein the controller is further configured to activate a spoil material clearing operation if the measured weight exceeds the threshold weight.

4. The mobile excavation vacuum apparatus as set forth in claim 2 wherein the controller is configured to enable addition of spray water into at least one of the separation vessel and the cyclone when the measured weight exceeds the threshold weight.

5. The mobile excavation vacuum apparatus as set forth in claim 4 when the controller is communicatively coupled to a (1) spray pump to selectively power the spray pump to introduce spray water through one or more nozzle assemblies mounted to the at least one of the separation vessel and the cyclone or (2) spray water valving that selectively directs spray water to one or more nozzle assemblies mounted to the at least one of the separation vessel and the cyclone.

6. The mobile excavation vacuum apparatus as set forth in claim 2 further comprising an excavation fluid pump, the controller being configured to transmit a signal to deactivate the excavation fluid pump when the measured weight exceeds the threshold weight.

7. The mobile excavation vacuum apparatus as set forth in claim 6 wherein the excavation fluid pump is configured to be deactivated until a user interacts with a console to activate the excavation fluid pump.

8. The mobile excavation vacuum apparatus as set forth in claim 2 further comprising a vacuum pump, the controller being configured to transmit a signal to deactivate the vacuum pump when the measured weight exceeds the threshold weight.

9. The mobile excavation vacuum apparatus as set forth in claim 8 wherein the vacuum pump is configured to be deactivated until a user interacts with a console to activate the vacuum pump.

10. The mobile excavation vacuum apparatus as set forth in claim 2 wherein the controller is configured to activate a warning signal on a user interface to warn an operator when the measured weight exceeds the threshold weight.

11. The mobile excavation vacuum apparatus as set forth in claim 10 wherein the warning signal may only be deactivated by a user interacting with a console.

12. The mobile excavation vacuum apparatus as set forth in claim 1 wherein the sensor system comprises a load cell.

13. The mobile excavation vacuum apparatus as set forth in claim 1 wherein the separation vessel and the cyclone form part of a weighed system, the weighed system being suspended from a mounting frame by a rotational joint.

14. The mobile excavation vacuum apparatus as set forth in claim 1 further comprising a dewatering system comprising one or more screens for removing water from the spoil material, the first outlet and the second outlet discharging spoil material into the dewatering system.

15. A disentrainment system for removing spoil material from an airstream comprising:

a separation vessel for continuously removing spoil material from the airstream, the separation vessel having an airlock at a first outlet through which spoil material is discharged;

a cyclone for removing spoil material from the airstream, the cyclone having a cyclone discharge pump at a second outlet through which spoil material is discharged;

a sensor system comprising a sensor for weighing the separation vessel, the cyclone, and the spoil material within the separation vessel and the cyclone; and a controller for receiving a signal from the sensor system to determine a measured weight of at least a portion of the disentrainment system, the controller configured to compare the measured weight to a threshold weight.

16. The disentrainment system as set forth in claim 15 wherein the controller is further configured to activate a spoil material clearing operation if the measured weight exceeds the threshold weight.

17. The disentrainment system as set forth in claim 16 comprising a spray system configured to add spray water to the separation vessel, the spoil material clearing operation comprising adding spray water to the separation vessel.

18. The disentrainment system as set forth in claim 17, wherein the spray system is configured to add spray water to the cyclone, the spoil material clearing operation comprising adding spray water to the cyclone.

19. The disentrainment system as set forth in claim 16 wherein the threshold weight is a first threshold weight and the spoil material clearing operation is a first spoil material clearing operation, the controller being configured to activate a second spoil material clearing operation if the measured weight exceeds a second threshold weight.

20. The disentrainment system as set forth in claim 16 wherein the spoil material clearing operation comprises powering off an excavation fluid pump.

21. The disentrainment system as set forth in claim 20 wherein the excavation fluid pump is configured to be deactivated until a user interacts with a console to activate the excavation fluid pump.

22. The disentrainment system as set forth in claim 16 wherein the spoil material clearing operation comprises powering off a vacuum pump.

23. The disentrainment system as set forth in claim 22 wherein the vacuum pump is configured to be deactivated until a user interacts with a console to activate the vacuum pump.

24. The disentrainment system as set forth in claim 16 wherein the spoil material clearing operation comprises activating a warning signal on a user interface to warn an operator.

25. The disentrainment system as set forth in claim 24 wherein the warning signal may only be deactivated by a user interacting with a console.

26. The disentrainment system as set forth in claim 15 wherein the sensor is a load cell.

27. A method for monitoring build-up of spoil material in a disentrainment system of a mobile excavation vacuum apparatus, the method comprising:

vacuuming spoil material from an excavation site by entraining the spoil material in an airstream;

introducing the airstream having spoil material entrained therein into a separation vessel to remove the spoil material from the airstream, the separation vessel having an airlock at a first outlet through which spoil material is discharged;

introducing the airstream having spoil material entrained therein to a cyclone to remove the spoil material from the airstream, the cyclone having a cyclone discharge pump at a second outlet through which spoil material is discharged; and monitoring the weight of the separation vessel, the cyclone, and the spoil material within the separation vessel and the cyclone to determine if spoil material is building up in at least one of the separation vessel and the cyclone.

28. The method as set forth in claim 27 comprising activating a spoil material clearing operation if the weight of the separation vessel, the cyclone, and the spoil material within the separation vessel and the cyclone exceeds a threshold weight.

29. The method as set forth in claim 28 wherein the spoil material clearing operation comprises adding spray water to at least one of the separation vessel and the cyclone to clear the build-up of spoil material in at least one of the separation vessel and the cyclone.

30. The method as set forth in claim 29 wherein the spray water is added to the separation vessel and/or the airlock.

31. The method as set forth in claim 29 wherein the spray water is added to the cyclone.

32. The method as set forth in claim 27 comprising deactivating an excavation fluid pump if the weight of the separation vessel, the cyclone, and the spoil material within the separation vessel and the cyclone exceeds a threshold weight.

33. The method as set forth in claim 32 wherein the excavation fluid pump is deactivated until a user interacts with a console to activate the excavation fluid pump.

34. The method as set forth in claim 27 comprising deactivating a vacuum pump if the weight of the separation vessel, the cyclone, and the spoil material within the separation vessel and the cyclone exceeds a threshold weight.

35. The method as set forth in claim 34 wherein the vacuum pump is deactivated until a user interacts with a console to activate the vacuum pump.

36. The method as set forth in claim 27 comprising activating a warning signal on a user interface to warn an operator when the measured weight exceeds a threshold weight.

37. The method as set forth in claim 36 wherein the warning signal may only be deactivated by a user interacting with a console.

* * * * *